US008615825B2

(12) United States Patent
Bovill et al.

(10) Patent No.: US 8,615,825 B2
(45) Date of Patent: Dec. 31, 2013

(54) LIQUID DRAINAGE SYSTEM

(75) Inventors: Richard Bovill, County Down (GB); Keith Nixon, County Down (GB)

(73) Assignee: Munster Simms Engineering Limited, Bangor, County Down (GB)

( * ) Notice: Subject to any disclaimer, the term of this patent is extended or adjusted under 35 U.S.C. 154(b) by 47 days.

(21) Appl. No.: 13/139,464

(22) PCT Filed: Dec. 15, 2009

(86) PCT No.: PCT/EP2009/008985
§ 371 (c)(1),
(2), (4) Date: Jul. 7, 2011

(87) PCT Pub. No.: WO2010/069551
PCT Pub. Date: Jun. 24, 2010

(65) Prior Publication Data

US 2012/0102639 A1 May 3, 2012

(30) Foreign Application Priority Data

Dec. 15, 2008 (GB) ..... 0822746.4

(51) Int. Cl.
*E03C 1/12* (2006.01)

(52) U.S. Cl.
USPC ..... 4/679

(58) Field of Classification Search
USPC ..... 4/679–694
See application file for complete search history.

(56) References Cited

FOREIGN PATENT DOCUMENTS

| | | |
|---|---|---|
| GB | 2310374 | 8/1997 |
| GB | 2424368 | 9/2006 |
| WO | 2008/137554 | 11/2008 |

OTHER PUBLICATIONS

Search Report and Written Opinion, dated Mar. 23, 2010, corresponding to International Application No. PCT/EP2009/008985 (filed Dec. 15, 2009), parent of the present application, 9 pp.

*Primary Examiner* — Lori Baker
(74) *Attorney, Agent, or Firm* — Lathrop & Gage LLP

(57) ABSTRACT

A liquid drainage system for a sanitary installation has a liquid level sensor for detecting the level of liquid in a drainage receptacle. The sensor employs non-contact sensing, for example an electric field, to detect the liquid level and controls the operating of a drainage pump depending on the detected liquid level. The drainage receptacle may for example be the gulley of a shower tray, or a manifold connected to two or more sinks.

19 Claims, 4 Drawing Sheets

LIQUID DRAINAGE SYSTEM

CROSS-REFERENCE TO RELATED APPLICATIONS

This application is the United States National Stage of International Application No. PCT/EP2009/008985, filed Dec. 15, 2009, which claims the benefit of Patent Application GB 0822746.4, filed Dec. 15, 2008, which is hereby incorporated by reference to the extent there is no inconsistency with the present disclosure.

FIELD OF THE INVENTION

The present invention relates to liquid drainage systems. The invention relates particularly to liquid drainage systems for use with sanitary installations, especially showers, baths, sinks and the like.

BACKGROUND TO THE INVENTION

Some sanitary installations require the use of a pump to drain water from the installation. For example, in the shower of a boat, it is known to provide an electrically operable pump for draining water from the shower tray. It is undesirable for the pump to be in operation while there is no water in the shower tray. In some cases, therefore, a switch is provided in the shower cubicle for activating the pump, the user being required to hold the switch in an "on" position while the shower is in use. This is inconvenient and so it is also known to incorporate a timer into the switch circuit such that the pump operates for a period of time after activation of the switch and then turns off. However, this can result in the pump continuing to operate for a limited period after the water has been drained from the tray.

It would be desirable to provide a system that overcomes the problem outlined above.

SUMMARY OF THE INVENTION

Accordingly, a first aspect of the invention provides a liquid drainage system comprising a drainage receptacle having a liquid outlet; a drainage pipe in liquid communication with said drainage receptacle via said liquid outlet; means for pumping liquid from said drainage receptacle into said drainage pipe via said liquid outlet; and a liquid level sensor arranged to detect the level of liquid in said drainage receptacle, wherein said liquid level sensor is arranged to generate at least one control signal depending on the detected liquid level and to communicate said at least one control signal to said pumping means, the pumping means being arranged to selectively pump liquid from said drainage receptacle in accordance with said at least one control signal, and wherein said liquid level sensor includes non-contact sensing means for detecting the level of liquid in the receptacle.

Preferably, said liquid level sensor comprises at least one electric field sensor. In preferred embodiments, the sensor may comprise any conventional electromagnetic field sensor (s).

Advantageously, said non-contact sensing means is provided in the system such that it is not in direct contact with the liquid whose level is to be measured. For example, said liquid level sensor may be located externally of said receptacle, for example in or on a wall or other exterior surface of said receptacle. Alternatively, said liquid level sensor is located inside of said receptacle, preferably within a substantially liquid-tight covering. The non-contact sensing means typically generates at least one sensing field, interaction between the at least one sensing field and the liquid to be measured allowing the non-contact sensing means to detect the liquid level.

In some embodiments, said drainage pipe extends substantially laterally from said receptacle, said outlet being located in a side wall of said receptacle, and wherein said liquid level sensor is, conveniently, oppositely disposed on said receptacle with respect to said outlet.

Preferably, said liquid level sensor is positioned to detect when the liquid level in said receptacle substantially covers said outlet.

In some embodiments, said receptacle comprises a galley, for example a gully for a shower tray, basin, bath or other sanitary installation.

In alternative embodiments, said receptacle comprises a manifold, for example a manifold connectable to at least one sanitary installation, such as a shower, basin or bath.

In some embodiments, said at least one control signal generated by the liquid level sensor at the receptacle is used to turn the pumping means on and off as appropriate. Preferably, said sensor is arranged to define a single liquid threshold level and to cause the pumping means to be turned on or off depending on the detected liquid level relative to said single liquid threshold level. Alternatively, said sensor is arranged to define a respective liquid threshold level for turning the pumping means off and a respective liquid threshold level for turning the pumping means on.

In alternative embodiments, said at least one control signal generated by the liquid level sensor at the receptacle is used to turn the pumping means on, a second liquid level sensor being provided for generating at least one control signal for turning the pumping means off, wherein said second liquid level sensor is located between said receptacle and said pumping means, preferably substantially at said pumping means.

A second aspect of the invention provides a drainage receptacle, for example a gulley, manifold or tank, having at least one liquid inlet and at least one liquid outlet, and a liquid level sensor arranged to detect the level of liquid in said drainage receptacle, wherein said liquid level sensor is arranged to generate at least one control signal depending on the detected liquid level, and wherein said liquid level sensor includes non-contact sensing means for detecting the level of liquid in the receptacle.

A third aspect of the invention provides a method of draining liquid from a drainage receptacle, the method comprising: detecting the level of liquid in said drainage receptacle; generating at least one control signal depending on the detected liquid level; and selectively pumping, in response to said at least one control signal, liquid from said drainage receptacle, wherein said liquid level sensor includes non-contact sensing means for detecting the level of liquid in the receptacle.

Preferred features of the invention are recited in the dependent claims.

Further advantageous aspects of the invention will become apparent to those ordinarily skilled in the art upon review of the following description of specific embodiments and with reference to the accompanying drawings.

BRIEF DESCRIPTION OF THE DRAWINGS

Embodiments of the invention are now described by way of example in which like numerals are used to indicate like parts and in which.

DETAILED DESCRIPTION OF THE DRAWINGS

Figure 1:
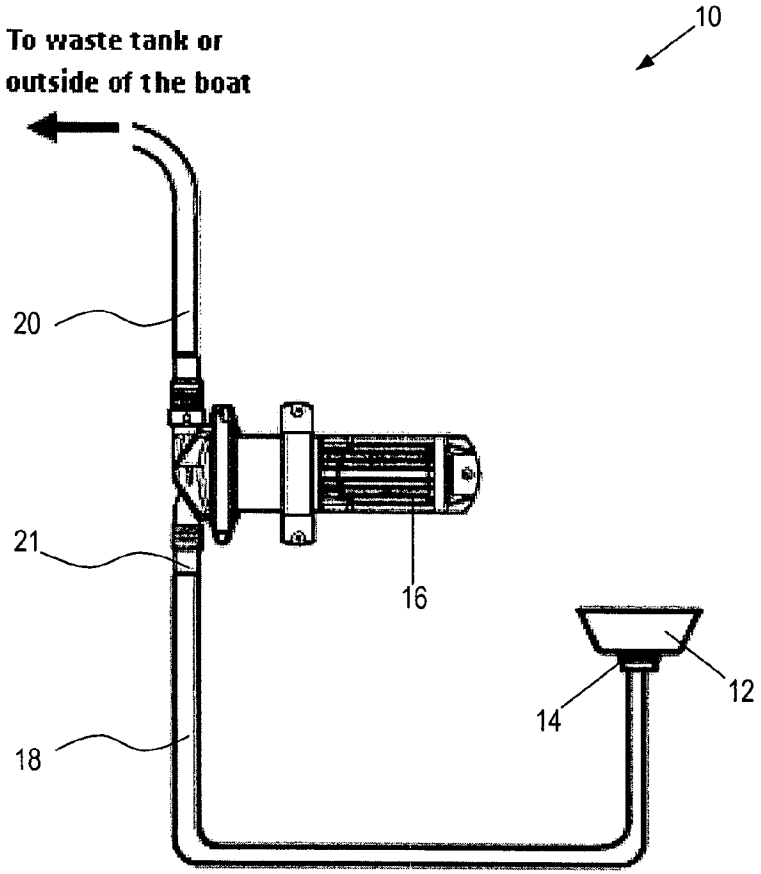
FIG. 1 is a schematic view of a first liquid drainage system embodying the invention.

Referring now to FIG. 1 of the drawings, there is shown, generally indicated as 10, a liquid drainage system embodying the invention. In the illustrated embodiment and by way of example, the system 10 comprises a waste water drainage system for a sanitary installation such as a shower, bath or basin. The system 10 may be installed in any suitable location, for example in a building or on a vessel. For the purposes of illustration, it is assumed that the sanitary installation is a shower as represented by shower tray 12.

The system 10 includes a drainage receptacle in the form of a gulley 14. The gulley 14 is fitted to the shower tray 12 (or other sanitary installation as applicable) to receive waste water (not shown) that drains in use from the shower tray 12. Typically, the gulley 14 is fitted to the base of the tray 12 in register with a drainage outlet of the tray 12. The gulley 14 has an outlet 15 (not shown in FIG. 1) through which the water may be drained as is described in more detail hereinafter.

The system 10 also includes a pump 16, which may take any suitable conventional form. The pump 16 is a power-operated, e.g. electrically operated, pump as opposed to being manually operated. A drainage pipe 18 is connected between the gulley 14 and the pump 16. A second drainage pipe 20 leads from the pump 16 to a drainage destination such as a waste water tank or the exterior of a vessel. In use, when the pump 16 is switched on, it draws water from the gulley 14, through drainage pipe 18, and expels it to the drainage destination via drainage pipe 20.

The pump 16 preferably includes, or is otherwise co-operable with, a control system (not illustrated) for controlling the operation of the pump 16 in response to receiving one or more control signals. The control system typically comprises electrical and/or electronic circuitry for receiving control signals and operating the pump 16 accordingly. Advantageously, the control system includes a programmable processor.

The system 10 further includes a liquid level sensor 22 (not shown in FIG. 1) for detecting the level of water in the gulley 14. Depending on the water level detected by the sensor 22, the sensor generates one or more control signals for controlling the operation of the pump. The control signals may be communicated to the pump's control system by any suitable means, e.g. by a wired or wireless connection (not illustrated). In the preferred embodiment, the sensor 22 is arranged to detect whether or not the water level meets a threshold level and, if so, to send a control signal to activate the pump 16. If the detected water level is less than the threshold, then the pump 16 is deactivated, or not activated, as applicable. Typically, the sensor 22 sends a deactivating signal to the pump 16 when it detects that the water level has dropped below the threshold although, alternatively, the pump 16 may deactivate itself in the absence of an activating signal from the sensor 22. In an alternative embodiment (not illustrated) the sensor 22 may be capable of detecting whether or not the water level meets more than one threshold level, e.g. an upper threshold level at which the pump 16 is to be activated and a lower level at which the pump is to be deactivated. To this end, the sensor 22 may comprise a respective liquid level sensing device for each threshold.

Advantageously, the sensor 22 is a non-contact sensor, i.e. it employs means for detecting the level of liquid without having to be in contact with the liquid. In particular non-contact electromagnetic field sensors are preferred, although other non-contact sensors such as RF (radio frequency), capacitative, ultrasonic or magnetic sensors could alternatively be used. In the preferred embodiment, the sensor 22 is an electric field sensor comprising one or more electric field sensing elements or means, and any suitable conventional electric field sensor maybe used.

Figure 2:
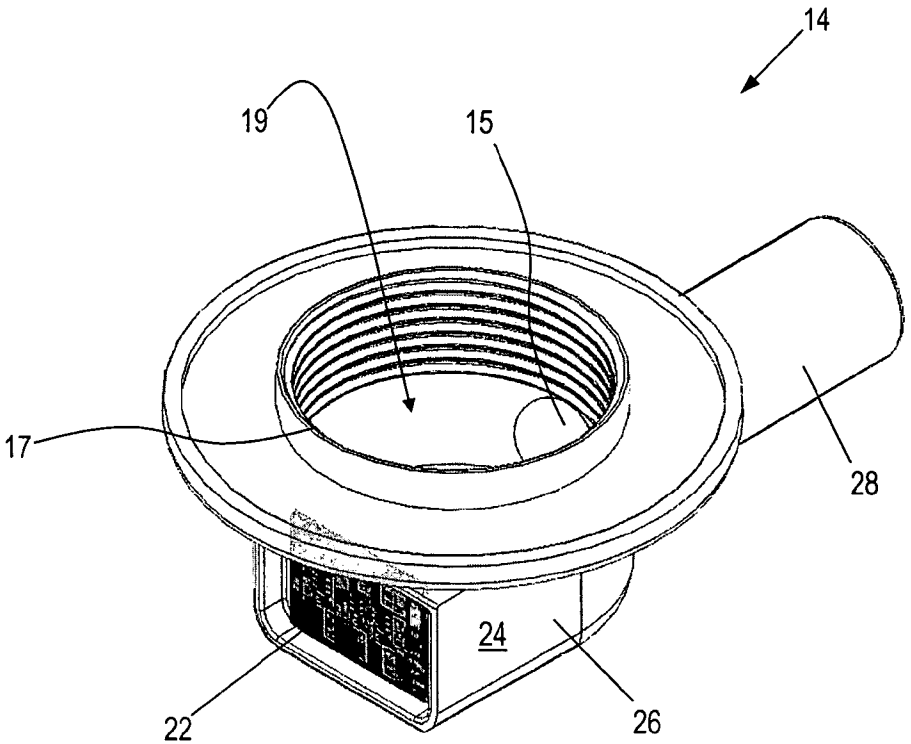
FIG. 2 is a perspective view of a gulley for use with the system of FIG. 1.

Referring now to FIG. 2, there is shown a preferred embodiment of the gulley 14. The gulley 14 has an inlet 17 by which water may enter the gulley 14 from the shower tray 12, or other installation, and outlet 15 by which the water may drain from the gulley 14. The gulley 14 is shaped to define a receptacle 19 for the water between the inlet 17 and the outlet 15.

The sensor 22 does not need to be located inside the receptacle 19 since its sensing means does not need to be in contact with the water. Conveniently, therefore, the sensor 22 is located on an exterior surface 24 of the gulley 14, for example on the outside of the side wall 26. Alternatively, the sensor 22 may be incorporated into the body of the gulley 14, or located inside the receptacle 19 within a substantially liquid-tight covering (not illustrated). In any event, the sensor 22 is positioned such that the electric field (not illustrated), or other sensing field e.g. electromagnetic or magnetic, that it generates during use extends into the receptacle 19 at a location that corresponds with the threshold level for water in the receptacle 19. When water impinges upon the sensing field, it interacts with the field in a manner that is detectable by the sensor 22. In cases where it is desired to define more than one water level threshold in the receptacle, the sensor 22 may have a respective field sensing element arranged to a respective sensing field that extends into the receptacle 19 at a respective location that corresponds with the respective threshold level (or two separate sensors may be used to this end).

To accommodate situations where there is limited space beneath the installation to which the gulley 14 is fitted, it is preferred that the outlet 15 is located in a side of the gulley 15 so that the drainage pipe 18 may extend laterally from the gulley 14. To this end, the gulley 14 may have a connector 28 for connecting the pipe 18 to the outlet 15. In the preferred embodiment, where a single level threshold is defined, the preferred arrangement is such that the level threshold is located substantially in line with the in use upper boundary of the outlet 15. Under the action of the sensor 22, the pump 16 is switched on when the water level in the receptacle reaches the threshold, and turned off when the water level drops below the threshold. As a result, the pump 16 is not switched on until the pipe 18 is filled with water, and is not kept on when all or part of the outlet 15 is exposed to air, which avoids the undesirable effects of having air sucked into the pump 16. In alternative embodiments where separate "pump on" and "pump off" water level thresholds are defined within the receptacle 19, one option is to arrange for the "pump on" threshold to be located substantially in line with the in use upper boundary of the outlet 15, the "pump off" threshold being positioned below this level. Alternatively, the "pump off" threshold is located substantially in line with the in use upper boundary of the outlet 15, the "pump on" threshold being positioned above this level.

In use, the sensor 22 causes the pump 16 to be turned on and off depending on the level of water in the gulley 14, thereby overcoming the problems identified above in relation to manually operated switch for operating the pump.

Another problem that is faced is that the frequency with which the pump 16 is turned off and on is relatively high. This cycling of the pump can be irritating for the user and wearing for the pump. Also, the system described above causes a quantity of water to remain in the pipe 18 after the pumping has finished.

Optionally, therefore, a second sensor (not shown), which may be substantially the same as or similar to the sensor 22, is provided between the gulley 14 and the pump 16, preferably substantially at the inlet 21 of the pump 16. The arrangement is such that the first sensor 22 provides a signal to turn the pump 16 on, while the second sensor provides a signal to turn the pump off. In particular, the second sensor is arranged to generate a signal for turning the pump 16 off when it detects a transition from a state where liquid was present in its sensing field to a state where liquid is no longer present in its sensing field. Hence, during use, when water fills the pipe 18 and fills the gulley 14 to the relevant threshold level, the sensor 22 turns the pump 16 on and, when the water has been drained from the pipe 18 to the extent that the sensing field of the second sensor no longer detects the presence of water, then the second sensor turns the pump 16 off. This mitigates the cycling problem and, by placing the second sensor substantially at the inlet of the pump 16, causes the pipe 18 to be drained.

Figure 3:
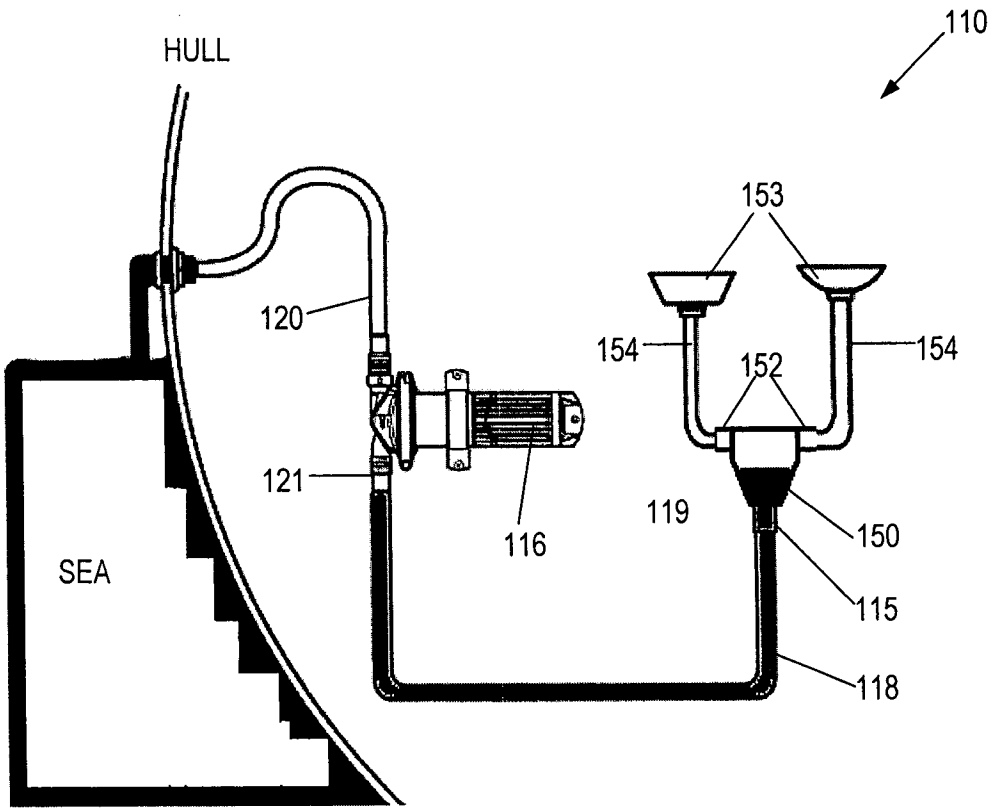
FIG. 3 is a schematic view of a second liquid drainage system embodying the invention.
Figure 4:
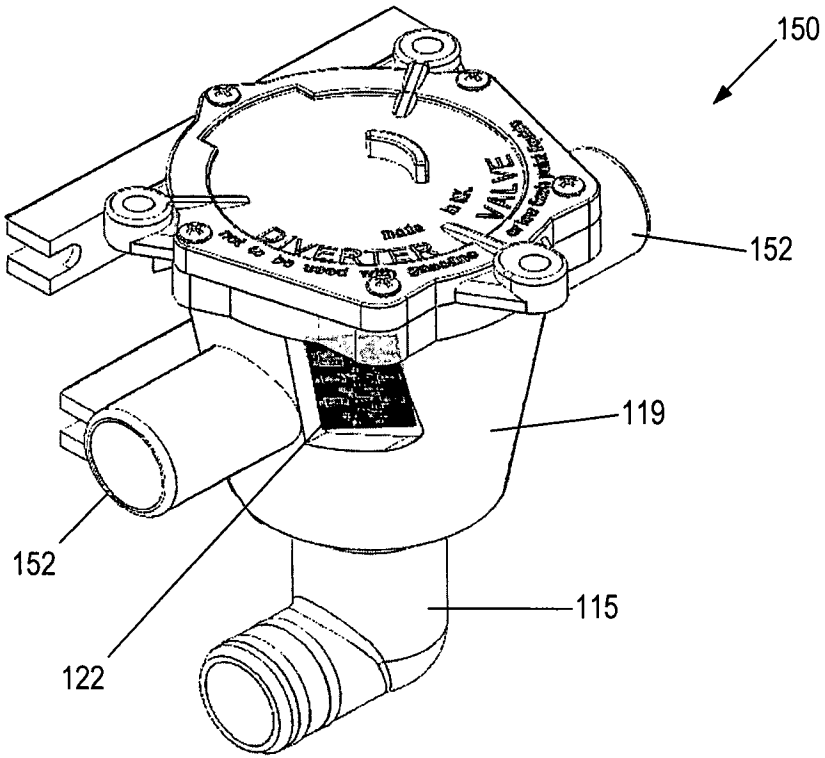
FIG. 4 is a perspective view of a manifold for use with the system of FIG. 2.

Referring now to FIGS. 3 and 4, there is shown, generally indicated as 110, a second liquid drainage system embodying the invention. The system 110 is similar to the system 10 and so the foregoing description of the system 10 applies to the system 110 as would be understood by a skilled person, like numerals being used to indicate like parts.

In this embodiment, the drainage receptacle is provided by a manifold 150 having a plurality of liquid inlets 152 (two in this example) for connection to a respective sanitary installation 153, such as a shower, bath or basin. Typically, a respective drainage pipe 154 is connected between the respective sanitary installation and the respective inlet 152. The manifold 150 has an outlet 115 for connection to the pump 116 via drainage pipe 118. The manifold defines a liquid receptacle 119 between its inlets 152 and its outlet 115.

A liquid level sensor 122, which may be substantially the same as or similar to the sensor 22, is provided on or in the manifold 150, preferably on an external surface of the manifold 150, or embedded in the body of the manifold 150, or within a water tight covering within the receptacle 119.

In one embodiment, a single sensor 122 is used to turn the pump 116 on and off. As for the sensor 22, sensor 122 may be of the type that generates one sensing field that is used to define a common on/off liquid level threshold, or may be of the type that generates a respective sensing field for defining separate on and off threshold levels. Preferably, the sensor 122 is positioned at the in use upper end of the manifold 150, for example at the top face or at a side adjacent the top.

In an alternative embodiment, the sensor 122 is arranged only to turn the pump 116 on, a second sensor (not shown) being provided for turning the pump 116 off. The second sensor may be substantially the same in configuration and arrangement as the second sensor of the system 10, and is preferably located substantially at the inlet 121 of the pump 116.

The invention is not limited to the embodiments described herein, which may be modified or varied without departing from the scope of the invention.

The invention claimed is:

1. A liquid drainage system comprising a drainage receptacle having a liquid outlet; a drainage pipe in liquid communication with said drainage receptacle via said liquid outlet; means for pumping liquid from said drainage receptacle into said drainage pipe via said liquid outlet; and a first liquid level sensor arranged to detect the level of liquid in said drainage receptacle, wherein said first liquid level sensor is arranged to generate a control signal to turn said pumping means on depending on the detected liquid level and to cause said control signal to be communicated to said pumping means, the pumping means being arranged to pump liquid from said drainage receptacle in response to said control signal, and wherein said first liquid level sensor includes non-contact sensing means for detecting the level of liquid in the receptacle, said system further including a second liquid level sensor configured to detect the level of liquid in said drainage pipe, said second liquid level sensor being configured to generate at least one control signal for turning said pumping means off depending on the detected liquid level in said pipe and to cause said at least one control signal to be communicated to said pumping means.

2. The liquid drainage system as claimed in claim 1, wherein said first liquid level sensor is arranged to define a first liquid threshold level and to generate said control signal to cause the pumping means to be turned on depending on the detected liquid level relative to said first liquid threshold level.

3. The liquid drainage system as claimed in claim 2, wherein said first liquid level sensor is arranged to generate a control signal to cause the pumping means to be turned off depending on the detected liquid level relative to said first liquid threshold level.

4. The liquid drainage system as claimed in claim 1, wherein said first liquid level sensor is arranged to define a second liquid threshold level and to generate said a control signal to cause the pumping means to be turned off depending on the detected liquid level relative to said second liquid threshold level.

5. The liquid drainage system as claimed in claim 4, wherein said second liquid threshold level is located in use below said first liquid threshold level.

6. The liquid drainage system as claimed in claim 1, wherein said drainage pipe connects said receptacle to said pumping means and said second liquid level sensor is located between said receptacle and said pumping means.

7. The liquid drainage system as claimed in claim 1, wherein said pumping means is located above said drainage receptacle.

8. The liquid drainage system as claimed in claim 1, wherein said non-contact sensing means is arranged to project at least one sensing field into said drainage receptacle.

9. The liquid drainage system as claimed in claim 8, wherein said first liquid level sensor is mounted on an exterior surface of said drainage receptacle.

10. The liquid drainage system as claimed in claim 8, wherein said first liquid level sensor is incorporated into the body of said drainage receptacle.

11. The liquid drainage system as claimed in claim 8, wherein said first liquid level sensor is located inside of said receptacle within a liquid-tight covering.

12. The liquid drainage system as claimed in claim 1, wherein said first liquid level sensor comprises at least one electric field sensor.

13. The liquid drainage system as claimed in claim 1, wherein said drainage pipe extends substantially laterally from said receptacle, said outlet being located in a side wall of said receptacle, said first liquid level sensor being positioned to detect when the liquid level in said receptacle substantially covers said outlet, and being configured to turn said pumping means on in response to determining that the liquid level in said receptacle substantially covers said outlet.

14. The liquid drainage system as claimed in claim 13, wherein said first liquid level sensor is oppositely disposed on said receptacle with respect to said outlet.

15. The liquid drainage system as claimed in claim 13, wherein said first liquid level sensor is arranged to generate said at least one control signal to cause the pumping means to be turned off upon detecting that the liquid level does not cover said outlet.

16. The liquid drainage system as claimed in claim 1, wherein said drainage receptacle comprises a gulley for a sanitary installation.

17. The liquid drainage system as claimed in claim 1, wherein said drainage receptacle comprises a manifold connectable to at least one sanitary installation.

18. A method of draining liquid from a drainage receptacle, the method comprising: detecting at a first liquid sensor the level of liquid in said drainage receptacle; generating a control signal to turn on said pumping means depending on the detected liquid level; pumping, in response to said control signal, liquid from said drainage receptacle, wherein said first liquid level sensor includes non-contact sensing means for detecting the level of liquid in the receptacle; detecting at a second sensor the level of liquid in a drainage pipe in fluid communication with said drainage receptacle via an outlet; generating at least one control signal for turning said pumping means off depending on the detected liquid level in said pipe; and causing said at least one control signal to be communicated to said pumping means.

19. The liquid drainage system of claim 6, wherein a second liquid level sensor is located substantially at said pumping means.

* * * * *

UNITED STATES PATENT AND TRADEMARK OFFICE

CERTIFICATE OF CORRECTION

PATENT NO. : 8,615,825 B2
APPLICATION NO. : 13/139464
DATED : December 31, 2013
INVENTOR(S) : Bovill et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 70 days.

Signed and Sealed this
Twenty-second Day of September, 2015

Michelle K. Lee

Michelle K. Lee
*Director of the United States Patent and Trademark Office*